US007357284B2

(12) United States Patent
Jauvin

(10) Patent No.: US 7,357,284 B2
(45) Date of Patent: Apr. 15, 2008

(54) TUBULAR SELF-RETRACTING DEVICE

(75) Inventor: Michel Jauvin, Sherbrooke (CA)

(73) Assignee: Ressort Parfait, Inc, Canton de Magog, Quebec (CA)

( * ) Notice: Subject to any disclaimer, the term of this patent is extended or adjusted under 35 U.S.C. 154(b) by 0 days.

(21) Appl. No.: 10/493,698

(22) PCT Filed: Apr. 28, 2003

(86) PCT No.: PCT/CA03/00609

§ 371 (c)(1),
(2), (4) Date: Apr. 27, 2004

(87) PCT Pub. No.: WO03/094660

PCT Pub. Date: Nov. 20, 2003

(65) Prior Publication Data

US 2005/0067449 A1 Mar. 31, 2005

(30) Foreign Application Priority Data

May 8, 2002 (CA) ..... 2383291

(51) Int. Cl.
*A45C 1/04* (2006.01)

(52) U.S. Cl. ..... 224/660; 224/254

(58) Field of Classification Search ..... 224/660, 224/254, 581, 582, 583; 119/781, 794, 796; 70/233

See application file for complete search history.

(56) References Cited

U.S. PATENT DOCUMENTS 828,823 A 8/1906 Maize
2,636,751 A 4/1953 Carlson ..... 281/44
2,643,803 A 6/1953 Bates ..... 224/5
3,547,323 A 12/1970 Sledge, Jr. ..... 224/28
4,332,054 A * 6/1982 Paist et al. ..... 16/197
4,460,174 A 7/1984 Perry ..... 273/84 R
4,870,843 A * 10/1989 Lundberg ..... 70/233
5,230,117 A 7/1993 Johnson et al. ..... 15/106
5,683,022 A 11/1997 Evans ..... 224/583
5,816,458 A 10/1998 Yonenoi ..... 224/182
5,864,925 A 2/1999 McGee ..... 24/3.11
6,038,748 A 3/2000 Durney et al. ..... 24/302
6,202,263 B1 3/2001 Harker ..... 24/300
6,299,040 B1 10/2001 Matias ..... 224/254
6,322,091 B1 * 11/2001 Lindley ..... 280/149.2
6,328,193 B1 * 12/2001 Schiff ..... 224/660
6,364,237 B1 4/2002 Kagel ..... 242/379
6,371,346 B1 4/2002 Sharma ..... 224/578
6,481,382 B2 * 11/2002 Cohn ..... 119/794
6,505,856 B1 * 1/2003 Jöhr et al. ..... 280/777
6,883,694 B2 * 4/2005 Abelow ..... 224/666

* cited by examiner

*Primary Examiner*—Lien M. Ngo
(74) *Attorney, Agent, or Firm*—Michael G. Gilman

(57) ABSTRACT

The tubular self-retracting device (2) has an elongated tubular element (6) having an open end, a cord (8) extending through the open end and fitting in the tubular element (6), a clipping element (10) attached to the cord (8) outside the tubular element (6) and an elongated spring means (3) mounted inside the tubular element (6), for urging the cord (8) inside the tubular element (6).

14 Claims, 6 Drawing Sheets

TUBULAR SELF-RETRACTING DEVICE

FIELD OF THE INVENTION

The present invention relates to devices for carrying articles, and more particularly to a tubular self-retracting device having an elongated spring element.

BACKGROUND

Plenty of retractable devices have been proposed for holding and carrying small personal articles on a user, such as keys, badges, etc. Usually, these devices can be clipped on an article of clothing to free the hands of the user so that he/she may accomplish other tasks.

It is easy to understand the need for such devices. A golf player, for example, often needs to clean his/her golf balls, clubs and other articles during the game. He/she usually uses a towel attached to his/her golf bag for this purpose. In doing so, he/she has little freedom of action and must lean to reach the towel. As another example, joggers often use a towel to wipe their face during the exercise. They presently have to hold the towel in their hands while running or to carry it in an uncomfortable backpack or belt pouch. There are many other occasions where it is desirable to have an article within reach and easily useable and storable.

Known in the art are U.S. Pat. No. 5,230,117 (Johnson et al.), U.S. Pat. No. 5,864,925 (McGee), and U.S. Pat. No. 6,364,237 (Kagel), which show examples of devices for holding and carrying various articles using a spring loaded cord retracting in a casing.

The retracting badge holder of Kagel is a good example of a self-retracting device. This device, usually clipped to a pants waistband, is particularly designed to carry a badge which can be required, for example, to access restricted areas. The retractable badgeholder consists of a wind-up spring mounted in a central cavity of a reel. A cord, to which a badge is fastened, is wound around the reel. The reel is mounted inside a small plastic casing. When the cord is pulled for using the badge, the reel rotates. Once the user releases the badge, the reel automatically rewinds the cord inside the casing.

Unfortunately, this type of device is prone to wear out prematurely if used in an outdoor environment. Eventually, water seeps through the compartment and the wind-up spring begins to rust, thus affecting the efficiency of the cord retraction mechanism. Also, the possible extension range of the cord is also limited due to construction of the retraction mechanism.

Also known in the art is U.S. Pat. No. 5,816,458 (Yonenoi), which shows an example of a retractable holder for arrangement of small personal articles. The holder consists of a tube housing a curled cord acting as a spring. A ring is fastened at each end of the curled cord for hooking articles. The rings also prevent the curled cord to disengage from the tube. The tube has an outer pin for attachment to a belt, a waistband, etc.

The above described devices are not adapted to carry heavier articles, like a possibly wet towel, a hat, tools, etc. Their cord and retracting mechanism are just not strong enough to retract these types of articles, and they are not built for long-lasting use especially in an outdoor environment.

These devices, along with most such devices, can be clipped to an article of clothing or to another object by means of a clip. Unfortunately, the devices might unclip when colliding with another article. The same could happen if a user hits the device inadvertently while practicing an activity. Precious personal items could be lost to the user's detriment.

Also known in the art are U.S. Pat. No. 2,636,751 (Carlson), U.S. Pat. No. 6,202,263 (Harker), U.S. Pat. No. 6,038,748 (Durney et al.), U.S. Pat. No. 6,299,040 (Matias), U.S. Pat. No. 5,683,022 (Evans), U.S. Pat. No. 3,547,363 (Sledge), U.S. Pat. No. 6,371,346 (Sharma), U.S. Pat. No. 6,328,193 (Schiff), and U.S. Pat. No. 4,460,174 (Perry), which show other examples of holders for personal items that can be worn on an article of clothing or to another article.

SUMMARY

An object of the present invention is to provide a self-retracting device for carrying an article, which is resistant and long-lasting to outdoor environments.

Another object of the present invention is to provide such a self-retracting device which is capable of supporting and operating with articles of many kinds, like a face towel or tools attached to it.

Another object of the present invention is to provide such a self-retracting device which is simple in construction and cost-competitive, yet is highly reliable.

Another object of the present invention is to provide such a self-retracting device which has an extensive cord range.

Another object of the present invention is to provide such a self-retracting device which can be clipped to an article of clothing or to another article.

Another object of the present invention is to provide such a device which can be integrated to a belt for convenient use.

According to the present invention, there is provided a tubular self-retracting device comprising an elongated tubular element having an open end, a cord extending through the open end and fitting in the tubular element, a clipping element attached to the cord outside the tubular element, and an elongated spring means mounted inside the tubular element, for urging the cord inside the tubular element.

Preferably, the spring means comprises a tension or a compression spring having opposite stationary and mobile ends. In the case of a tension spring, the mobile end is closer to the open end of the tubular element than the stationary end. The cord is attached to the mobile end inside the tubular element, and the stationary end is fastened to the tubular element at a distance from the open end corresponding to at least a length of the tension spring at rest plus a mobility range of the mobile end inside the tubular element. In the case of a compression spring, the mobile end is farther to the open end of the tubular element than the stationary end. The cord is attached to the mobile end, and the stationary end being fastened to the tubular element at a distance from an end of the tubular element opposite to the open end and corresponding at least to a length of the compression spring at full compression plus a mobility range of the mobile end inside the tubular element.

Preferably, the tubular self-retracting device comprises a belt longitudinally carrying the tubular element.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 1:
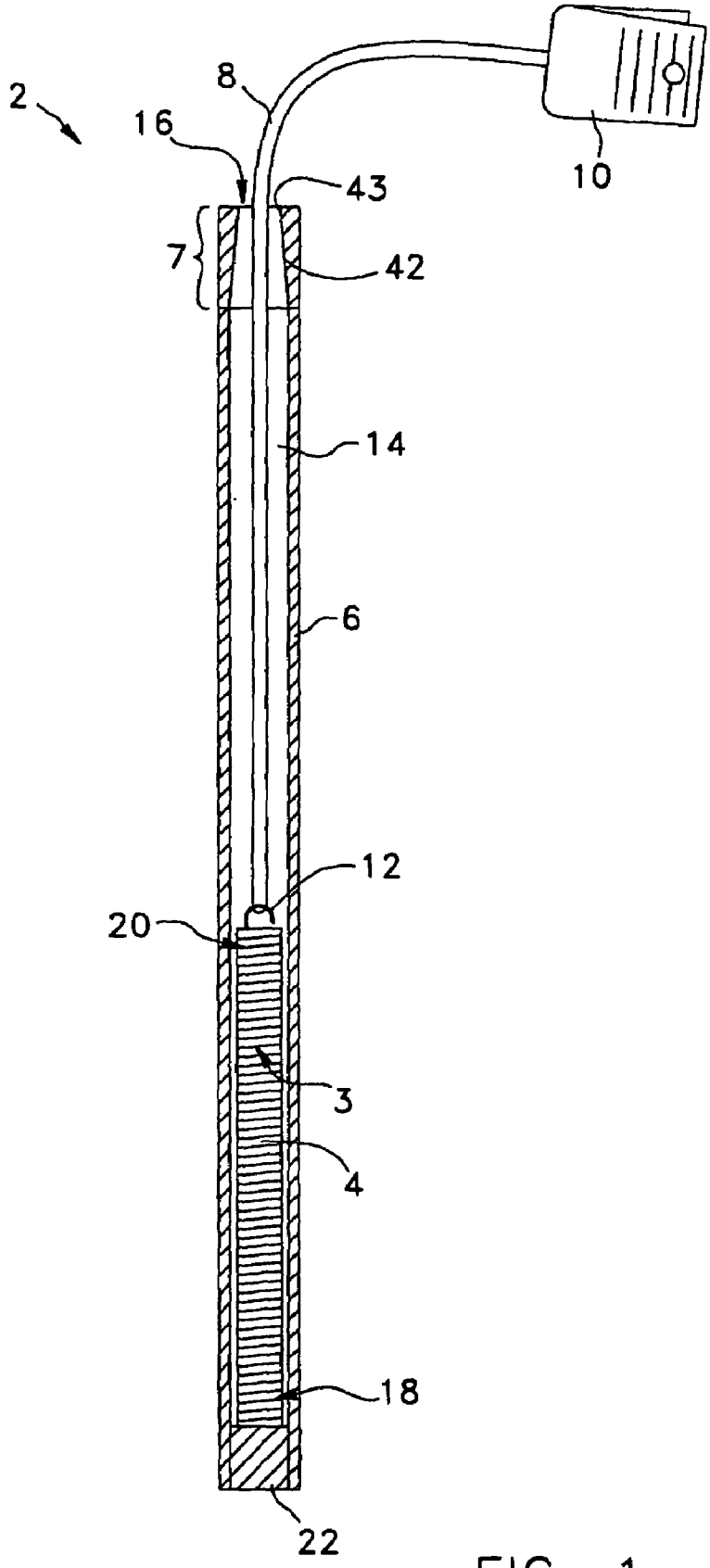
FIG. 1 is a schematic cross-section view of a tubular self-retracting device according to the present invention, with a tension spring in fully retracted position.

Referring to FIG. 1, there is shown a tubular self-retracting device 2 according to the present invention. The device 2 has an elongated tubular element in the form of a tube 6 housing a spring element 3, a cord 8 fastened to the spring element 3 and extending outside the tube 6, and a clip 10 attached to the cord 8 outside the tube 6.

The tube 6 has a longitudinal elongated cavity 14 guiding the spring element 3, and an open end 16 through which the cord 8 passes. The opposite end 22 of the tube 6 is preferably closed, but can be left open if desired. The open end 16 may be provided by a cap 7 screwed, glued or otherwise fastened to the tube 6. The advantage of having the cap 7 separated from the tube 6 is that the cap 7 can be removed for easy installation, maintenance or repair of the spring element 3 and the cord 8.

Advantageously, the open end 16 has a smooth inner surface 42 possibly with a rounded lip 43 to facilitate the gliding of the cord 8 in and out of the tube 6 and reducing the wear of the cord 8. In the illustrated case, the open end 16 has a smaller diameter than the diameter of the spring element 3 to prevent it from getting out of the tube 6. Any other suitable spring stopping arrangement can be used, e.g. an inner shoulder (not shown) inside the tube 6 near its open end 16.

When a user pulls the clip 10 or an article (not shown) held by the clip 10 or the cord 8 itself, the spring element 3 extends along the cavity 14 toward the open end 16. Once the user releases the cord 8, the cord 8 is drawn back in the tube 6 by the spring element 3.

The returning force of the spring element 3 is given by $F=K\Delta X$ (where K is the rigidity constant of the spring and $\Delta X$ is the difference between the final length and the initial length of the spring). Knowing that and the yield stress limit of the spring element 3, it is then easy to determine the maximum load that can be applied to the spring element 3 to avoid the spring element 3 to be permanently damaged or even broken apart. Likewise, the proper spring can be selected depending on the intended use.

The open end 16 of the tube 6 may be arranged so that the size of the opening fits closely the size of the cord. The open end 16 may alternately be provided with a rubber ring, a sealing gasket, etc. allowing passage of the cord 8 in a relatively tight manner while significantly repelling water from the cord 8 when the cord 8 is retracted by the spring element 3. Such coater proofing arrangements may be advantageous for using the device outdoors.

The tube 6 can be conveniently made of flexible material, like plastic, so as to adapt to various situations and conditions of use.

Figure 2:
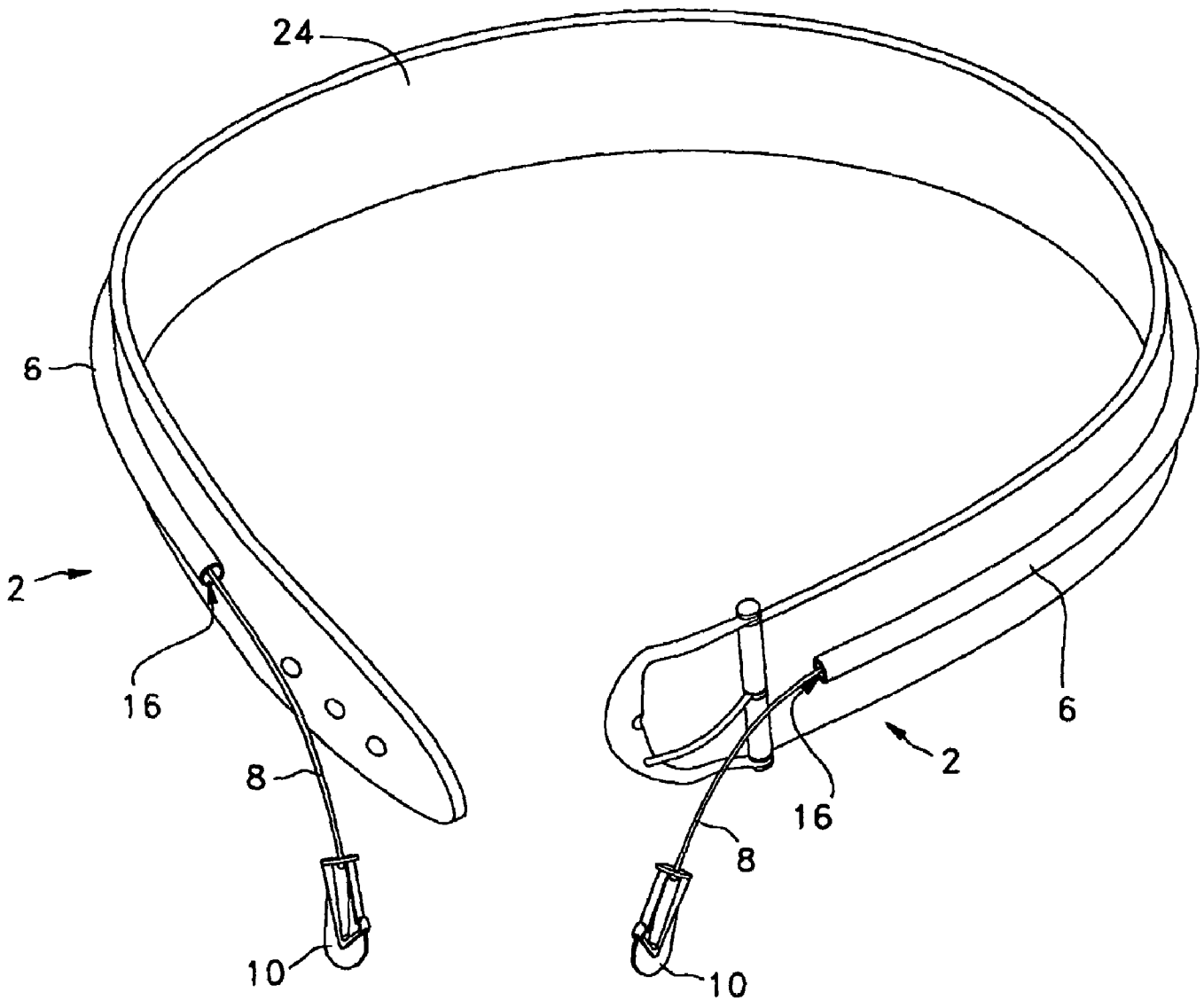
FIG. 2 is a schematic perspective view of a belt with two tubular self-retracting devices according to the present invention.

Referring to FIG. 2, one, two or more flexible tubes 6 can be conveniently incorporated to a belt 24. The tubes 6 can be inserted in appropriate fabric loops or an elongated fabric loop stitched on the belt 24 (not shown). The belt 24 can also be formed to contain the tubes 6 and be provided with eyelets for passage of the respective cords on a same side or on opposite sides of the belt 24. Any suitable kinds of belt attachments can be used. In the illustrated case, the tubes 6 are attached to the outer surface of the belt 24 with glue. An advantage of the loop attachment over the other kinds of attachment is that the tube(s) 6 is(are) not permanently fixed to the belt 24 and can be easily removed for use without the belt 24. The devices 2 mounted on the belt 24 are useful to carry articles used frequently, like a cleaning towel for golf clubs or shoes, a golf ball carrier, a hat, etc. It is also possible to use a single tube 6 (not shown) incorporated to the belt 24, and having two open ends 16, two independent spring elements 3, as well as two independent cords 8, mounted on opposite sides within the tubes 6 to allow separate use of the self-retracting devices 2. The belt 24 can be provided with pockets (not shown) housing the clips 10 and possibly the articles when in retracted position. One or more tubes 6 can also be incorporated to various other articles such as a golf bag, a pair of pants (e.g. directly in the waistband), etc.

Figure 3:
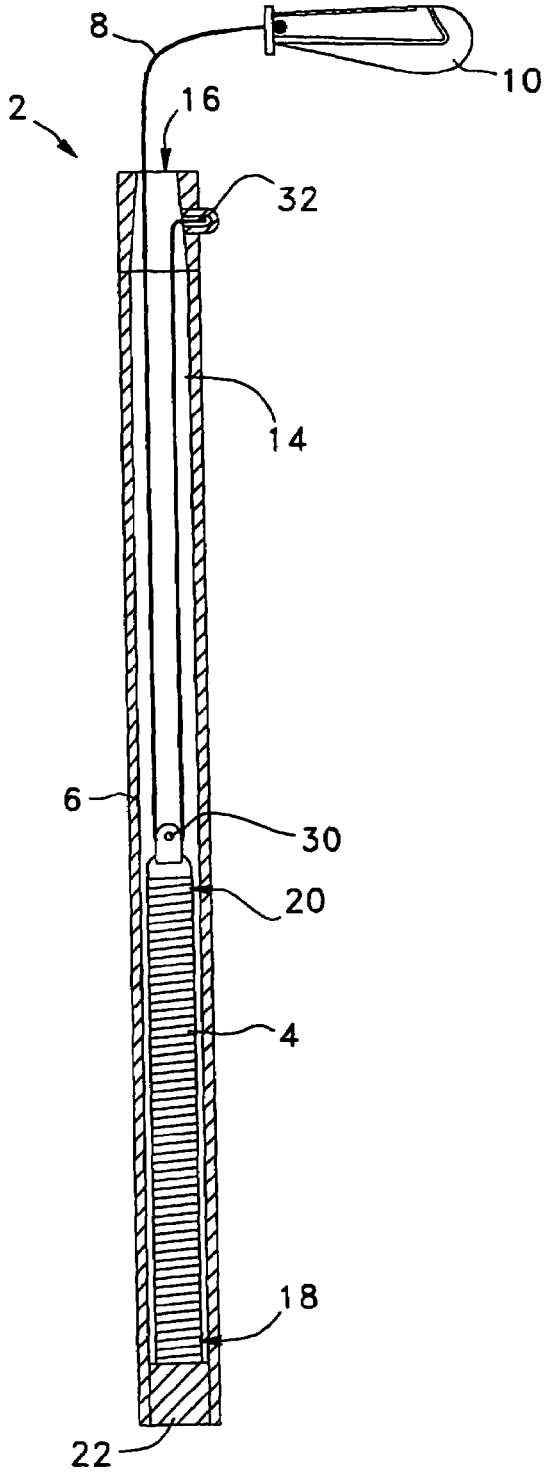
FIG. 3 is a schematic cross-section view of a tubular self-retracting device according to the present invention, with a cord running back arrangement.

Turning now to FIGS. 1 and 3, the spring element 3 can be conveniently formed of a tension spring 4 for retracting the cord 8 within the tube 6. The tension spring 4 has a stationary end 18 fastened to the closed end 22 of the tube 6, and an opposite mobile end 20 closer to the open end 16. The stationary end 18 of the tension spring 4 can also be fastened to the inner wall of the tube 6 provided that the stationary end 18 is fastened at a distance from the open end 16 corresponding to at least a length of the tension spring 4 at rest plus a mobility range of the mobile end 20 inside the tube 6. The mobility range is the range within which the tension spring 4 can be extended and may vary according to the design and arrangement of both the tube 6 and the tension spring 4.

As best shown in FIG. 1, the mobile end 20 of the tension spring 4 has a hook 12 to which the cord 8 is attached. Other attachments can be used if desired, e.g. a separate fastener, a bracket, etc. mounted at the end 20 of the tension spring 4.

The diameter of the cord 8 should be chosen to fit inside the tube 6 and to pass through the open end 16. The cord 8 is preferably made of elastic material, thereby increasing the possible extension range. The cord 8 may conveniently have a rubber core covered by a nylon jacket. The cord 8 can also be made of inelastic material if desired.

In the illustrated case, the clip 10 is formed of an alligator clip attached to the cord 8 outside the tube 6 and is used to clip an article to be carried by the device 2. Other types of clipping devices, such as tabbed hooks 10 (as shown in FIGS. 2 to 9) or any other clips to grasp various articles like a pincer for holding a beaker, can be used instead of the alligator clip. Optionally, the clip 10 could be arranged so that it is operated (opened and closed) by an independent remote system (not shown) located on the device. For example, a device 2 with a rigid cord and a pincer-like clip (not shown) could have a remote control fixed on the tube 6.

The remote control operates a motor mounted on the pincer-like clip. When activated, the motor drives the opening and the closing of the pincer-like clip.

It is also possible to affix more than one clip 10 to the cord 8. For example, two alligator clips fixed on the cord 8 and spaced from each other (not shown), can be used to clip one article using both clips or to clip two articles.

Preferably, the clip 10 has a size exceeding an opening size of the open end 16 of the tube 6 to prevent the clip 10 from getting into the tube 6. The tube 6 could be arranged to cover and protect the clip 10 when in retracted position.

Figure 5:
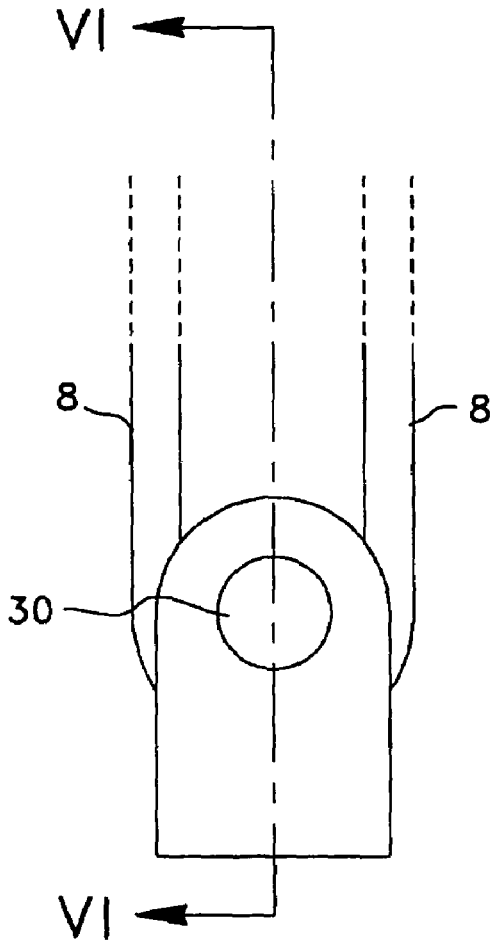
FIG. 5 is a schematic view of a transverse roller arrangement in a tubular self-retracting device according to the present invention.
Figure 6:
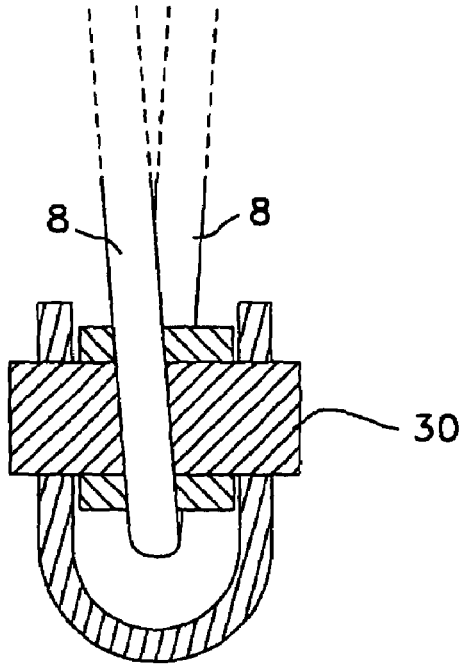
FIG. 6 is a schematic cross-section view taken along lines VI-VI in FIG. 5.

Referring to FIGS. 3, 5 and 6, instead of being directly fastened to the tension spring 4 by the hook 12 (as shown in FIG. 1), the cord 8 can be slidably attached to the mobile end 20 of the tension spring 4, and run back toward the open end 16 to a fastening point 32 inside the tube 6. The hook 12 is then preferably replaced by a transverse roller 30 (as best shown in FIGS. 5 and 6) weld or mounted to the mobile end 20 of the tension spring 4 to minimize the friction of the cord 8 with the tension spring 4. The advantage of the transverse roller 30 over the hook 12 is that less tension is required to pull out the cord 8 from the tube, since there is less friction. The cord 8 runs from the fastening point 32, around the transverse roller 30 and back through the open end 16. Other rollers 30 can be used within the tube 6 to house a still lengthier cord 8 within the tube 6. Instead of the roller 30, other devices, such as a pulley (not shown), can be used. Such a configuration increases the possible extension range of the cord as it is longer.

Figure 4:
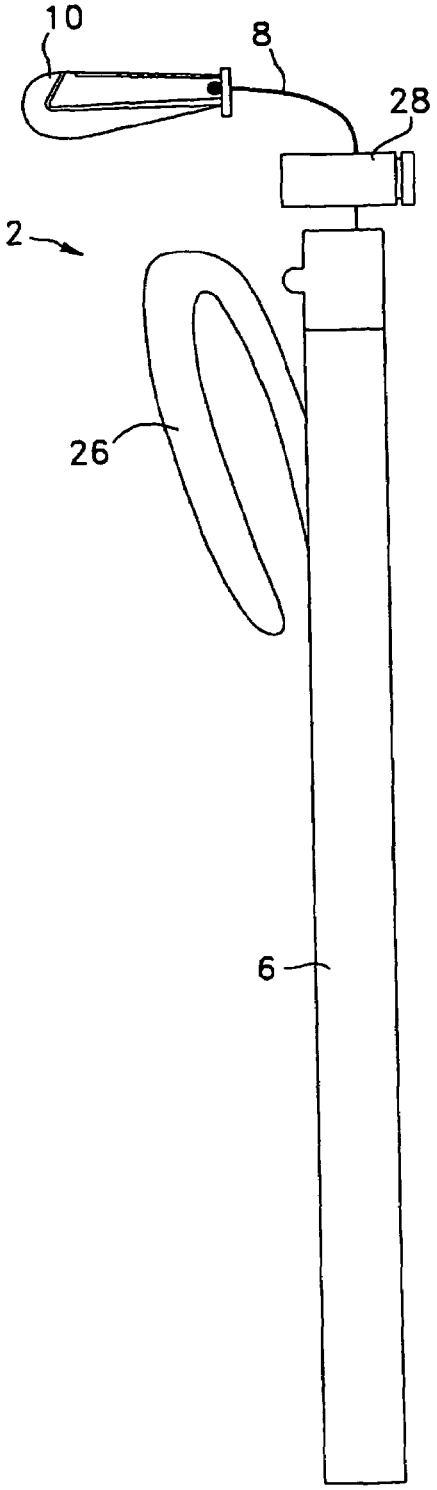
FIG. 4 is a schematic view of a tubular self-retracting device according to the present invention, with a cord locking device and an outer clip.

Referring to FIG. 4, the tube 6 can be provided with an outer clip 26 for clipping the tube 6 to a golf bag or any other desired articles. Other types of fasteners can be used for allowing the fastening of the tube 6 to an article.

A cord lock 28 or any other locking element can be provided for locking the cord 8 in drawn out position with respect to the tube 6. The cord lock 28 can be released (unlocked) and slid along the cord to a desired locking position. The cord lock 28 can be attached to the tube 6 or can be left movable along the cord 8.

Figure 7:
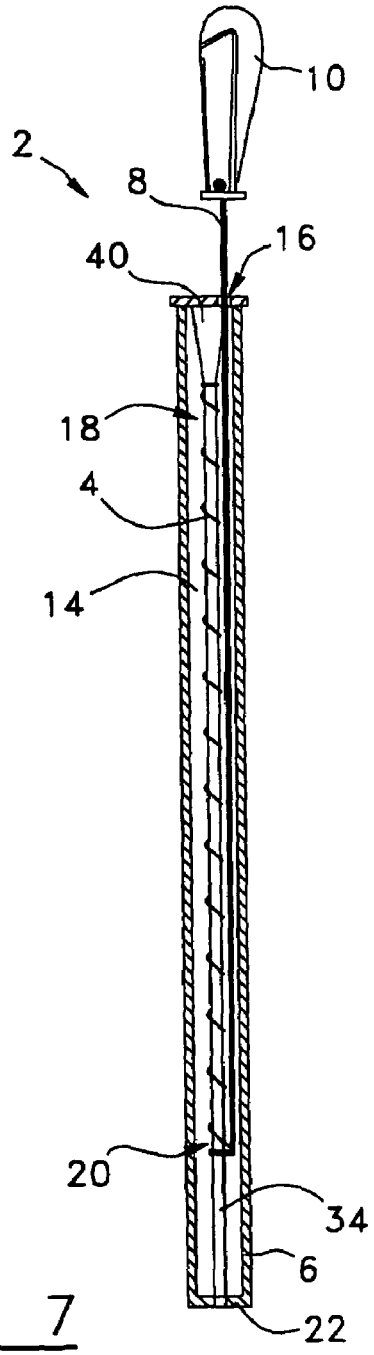
FIGS. 7 and 8 are schematic cross-section views of a tubular self-retracting device according to the present invention, with a compression spring in different operating positions respectively.
Figure 8:
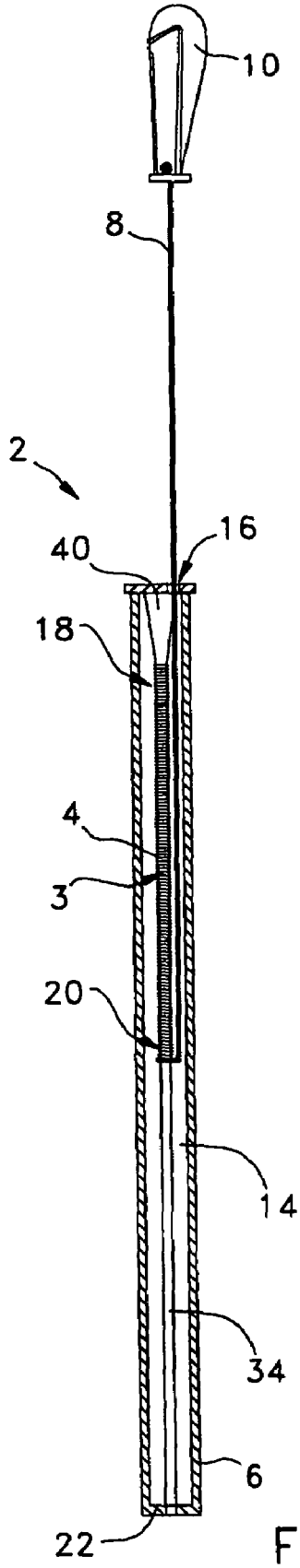

Referring to FIGS. 7 and 8, the spring element 3 can also be formed of a compression spring 4 mounted inside the tube 6 for retracting the cord 8 within the tube 6. FIG. 7 shows the compression spring 4 in a fully extended state while FIG. 8 shows the compression spring 4 in a fully compressed state.

The compression spring 4 has a stationary end 18 opposite to a mobile end 20. The mobile end 20 is farther to the open end 16 of the tube 6 than the stationary end 18. The mobile end 20 should be located at a distance corresponding to at least a length of the compression spring 4 at full compression plus a mobility range of the mobile end 20 inside the tube 6 to obtain maximum operation range. The cord 8 is attached to the mobile end 20. The cord 8 extends along the compression spring 4 between the mobile end 20 and the open end 16.

To provide longitudinal guidance of the compression spring 4 inside the tube 6, an elongated rod 34, fixed to the closed end 22 and the open end 16, extends through the compression spring 4. The rod 34 could also be fixed to only one of the closed end 22 or open end 16 for guiding the compression spring 4. The rod 34 is preferably made of flexible material, such as plastic, but other material like metal, can also be used. The cord 8 may also pass inside the compression spring 4 provided that no guiding rod is used, if desired. The tube 6 should then be sized to prevent bending of the compression spring 4 during compression. The opening 16 should preferably be aligned with the course of the cord 8 inside the tube 6.

Preferably, the stationary end 18 of the compression spring 4 is fastened to an enlarged end 40 of the rod 34 to prevent the compression spring 4 from sliding back and forth from one end of the tube 6 to another end. The stationary end 18 can lean against the enlarged end 40 without being fastened thereto, but in this case, the compression spring 4 will be free to slide along the rod 34 when no force is applied on the compression spring 4 by an article clipped to the clip 10. The end 40 is larger than the diameter of the compression spring 4 for the compression spring 4 to rest against it.

It is also possible to use a guiding rod like the rod 34 described above with the tension spring 4 of FIGS. 1 and 3. Again, the rod 34 can be attached to only one end of the tube 6.

Figure 9:
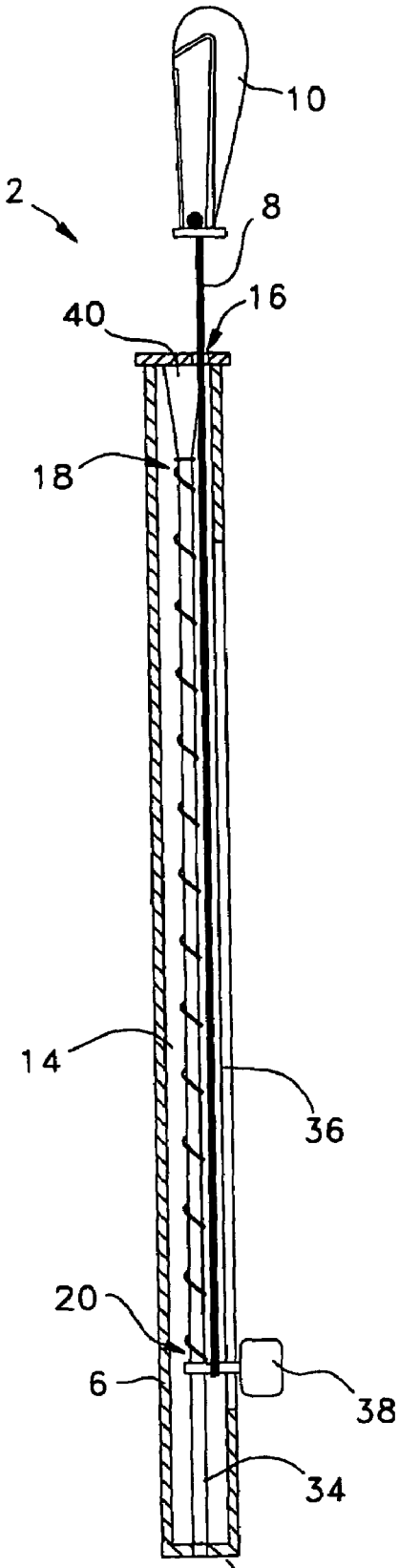
FIGS. 9 and 10 are schematic cross-section views of a tubular self-retracting device according to the present invention, with a moving lever.
Figure 10:
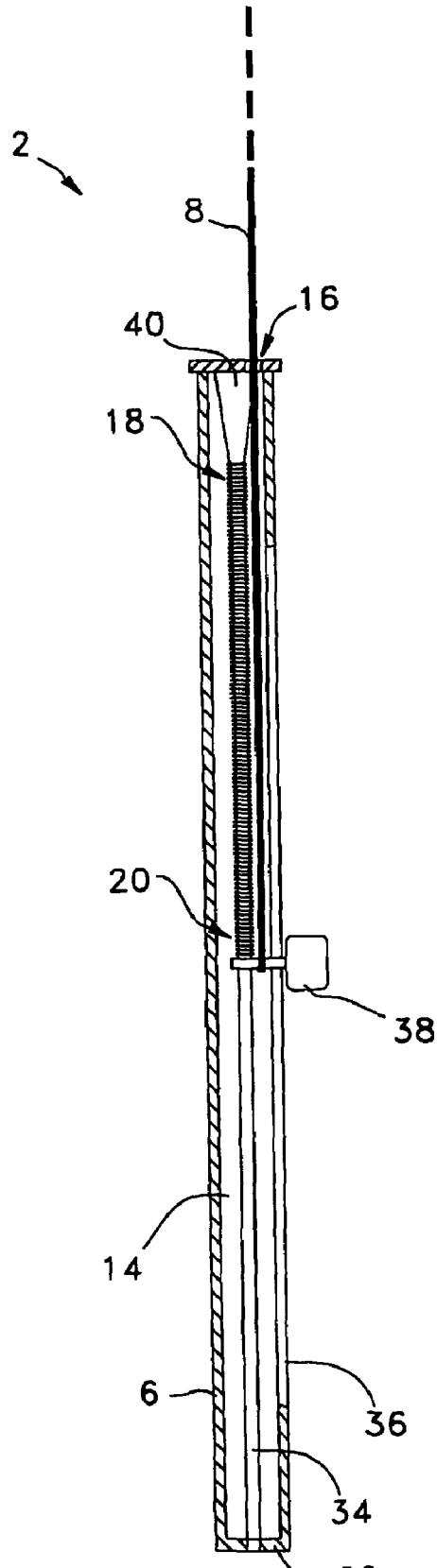

Referring to FIGS. 9 and 10, the tube 6 can also be rigid, for example, for carrying articles requiring more stability during transport, such as hazardous materials. The cord 8 may also be rigid for manipulating, for example, chemical or dangerous products from a safe distance and with certain precaution. The user might prefer the rigid cord over the flexible cord for personal reasons. The tube 6 may have a longitudinal guiding slot 36 extending at least over the mobility range of the mobile end 20 of the compression spring 4. A lever 38 connected to the mobile end 20 of the compression spring 4 slides in the slot 36 and can be used for manually compressing the compression spring 4 to draw out the cord 8 without having to pull the cord 8 out of the tube 6. As described before, using a rigid cord with the lever 38 may be appropriate when handling dangerous or hazardous objects, like chemical solutions, biomedical wastes, etc.

It is worth noting that in all the embodiments described above, as well as other possible embodiments, the spring element can be formed of a single spring, multiple springs attached to one another, an elastic, etc., and can be doubled for improved strength, while the cord may be arranged to run back and forth several times between the spring and the attachment point as in a pulley system for increasing the extension range of the cord. The tube can also be as long as desired, depending on the intended use or application.

While embodiments of this invention have been illustrated in the accompanying drawings and described above, it will be evident to those skilled in the art that changes and modifications may be made therein without departing from the essence of this invention.

The invention claimed is:

1. A tubular self-retracting device, comprising:

an elongated tubular element having an open end;

a cord extending through the open end and fitting in the tubular element;

a clipping element attached to the cord outside the tubular element;

an elongated spring means mounted inside the tubular element, for urging the cord inside the tubular element, and a releasable cord lock through which the cord is threaded, the releasable cord lock has a size exceeding an opening size of the open end of the tubular element, the cord lock being selectively positionable on the cord to draw out a length of the cord of variable size with respect to the tubular element and the cord lock being urged against the open end of the tubular element.

2. The tubular self-retracting device according to claim 1, wherein the spring means comprises a spring element longitudinally extending in the tubular element.

3. The tubular self-retracting device according to claim 2, wherein the spring element comprises a tension spring having opposite stationary and mobile ends, the mobile end being closer to the open end of the tubular element than the stationary end, the cord being attached to the mobile end inside the tubular element, and the stationary end being fastened to the tubular element at a distance from the open end corresponding to at least a length of the tension spring at rest plus a mobility range of the mobile end inside the tubular element.

4. The tubular self-retracting device according to claim 3, wherein the cord is fastened to the mobile end of the tension spring.

5. The tubular sell-retracting device according to claim 3, wherein the stationary end of the tension spring is attached to an end of the tubular element opposite to the open end.

6. The tubular self-retracting device according to claim 1, wherein the cord is elastic.

7. The tubular self-retracting device according to claim 6, wherein the cord has a rubber core covered by a nylon jacket.

8. The tubular self-retracting device according to claim 1, wherein the open end of the tubular element has a smooth inner surface.

9. The tubular self-retracting device according to claim 1, wherein the tubular element comprises an outer clip.

10. The tubular self-retracting device according to claim 1, wherein the clipping element has a size exceeding the opening size of the open end of the tubular element.

11. The tubular self-retracting device according to claim 1, wherein the clipping element comprises an alligator clip or tabbed hook.

12. The tubular self-retracting device according to claim 1, wherein the tubular element Is flexible.

13. The tubular self-retracting device according to claim 1, further comprising a belt longitudinally carrying the tubular element.

14. The tubular self-retracting device according to claim 1, wherein: the cord is substantially rigid; and wherein the tubular element has a longitudinal guiding slot extending over a mobility range of a mobile end of the spring means, and further comprising a lever sliding in the slot that is operable to move the cord from outside the tubular element.

* * * * *